US005988521A

United States Patent [19]

Nohynek

[11] Patent Number: 5,988,521

[45] Date of Patent: Nov. 23, 1999

[54] SPRAY ARM FOR COATING DEVICE AND METHOD OF SPRAYING A COATING THROUGH THE SPRAY ARM

[75] Inventor: Oliver Nohynek, Friedrichshafen, Germany

[73] Assignee: Draim Metallprodukt GmbH & Co. KG, Eriskirch, Germany

[21] Appl. No.: 08/755,126

[22] Filed: Nov. 22, 1996

[30] Foreign Application Priority Data

Nov. 25, 1995 [DE] Germany ..... 195 43 960

[51] Int. Cl.[6] ..... B05B 17/04

[52] U.S. Cl. ..... 239/11; 239/139; 239/76; 239/566; 137/561 A; 99/516; 118/24; 138/114

[58] Field of Search ..... 239/135, 139, 239/76, 433, 423, 548, 549, 554, 556, 557, 565, 566, 568, 536, 553, 553.3, 553.5, 11, 13; 137/561 A; 118/13, 24; 99/516; 138/114

[56] References Cited

U.S. PATENT DOCUMENTS

| | | | |
|---|---|---|---|
| 1,126,939 | 2/1915 | Batton | 239/557 X |
| 1,207,790 | 12/1916 | Peterson | 239/536 X |
| 3,237,236 | 3/1966 | King, Jr. | 239/566 X |
| 3,334,820 | 8/1967 | Flynn | 239/553.5 X |
| 3,730,505 | 5/1973 | Ramacciotti et al. | 239/549 X |
| 3,816,871 | 6/1974 | Karnofsky | 239/DIG. 13 X |
| 4,955,409 | 9/1990 | Tokuda et al. | 137/561 A |
| 5,108,034 | 4/1992 | Huey et al. . | |
| 5,322,081 | 6/1994 | Isaac . | |

FOREIGN PATENT DOCUMENTS

| | | |
|---|---|---|
| 2606296 | 5/1988 | France . |
| 2253633 | 9/1977 | Germany . |
| 2809286 | 10/1980 | Germany . |
| 4007080 | 9/1991 | Germany . |
| 9100980 | 7/1992 | Germany . |
| 432535 | 1/1995 | Germany . |
| 3816680 | 2/1995 | Germany . |
| 4325971 | 2/1995 | Germany . |
| 2193145 | 3/1988 | United Kingdom . |
| 2201359 | 9/1988 | United Kingdom . |

OTHER PUBLICATIONS

Copy of an Official Action dated May 29, 1996 in German Application No. 195 43 960.0.

*Primary Examiner*—Andres Kashnikow
*Assistant Examiner*—Steven J. Ganey
*Attorney, Agent, or Firm*—Greenblum & Berstein P.L.C.

[57] ABSTRACT

Spray arm for a coating device and a method of supplying a coating material to a spray arm. The spray arm including at least one nozzle pipe having an open end, a closed end, and at least one nozzle positioned between the open end and the closed end, and at least one delivery pipe having a supply end and a delivery end. The delivery end may be positioned adjacent the closed end of the at least one nozzle pipe, the open end of the at least one nozzle pipe may be couplable to a coating material supply, and the supply end of the at least one delivery pipe may be couplable to the coating material supply. The method includes supplying coating material to the at least one nozzle in a first direction substantially along a longitudinal axis of the at least one nozzle pipe, and supplying coating material to the at least one nozzle in a second direction, the second direction being substantially opposite the first direction.

16 Claims, 2 Drawing Sheets

8
9
7
P
U
6
5
4
3
2
1
21
29
22
11,20
25
15
10
12
NS
S

IV-IV
IV
IV
1
2
3
4
10
12
14
15
16
17
18
21
22
23
24
25
26
27
28
28'

SPRAY ARM FOR COATING DEVICE AND METHOD OF SPRAYING A COATING THROUGH THE SPRAY ARM

CROSS REFERENCE TO RELATED APPLICATION

The present invention claims the priority under 35 U.S.C. § 119 of German Patent Application No. 195 43 960.0 filed on Nov. 25, 1995, the disclosure of which is expressly incorporated by reference herein in its entirety.

BACKGROUND OF THE INVENTION

1. Field of the Invention

It is the object of the present invention to provide a spray arm for a coating device as, for example, is known from DE 43 23 535 A1 of the same applicant.

2. Discussion of Background Information

The object of invention of said application was to supply the nozzles, which are arranged on a nozzle pipe of the spray arm, over the length of the spray arm with a liquid which is as constant as possible, supplying said liquid compound to each nozzle.

If on one side of a nozzle pipe, on which is arranged a series of ejection nozzles, a high-viscosity compound is introduced, this will result in a proportional drop in pressure over the length of the nozzle pipe resulting in the first nozzle located in the direction, in which the compound is introduced, discharging comparatively more coating compound than the nozzle located at the end of the nozzle pipe.

This proportional drop pressure is disadvantageous and must be avoided.

SUMMARY OF THE INVENTION

In view of the foregoing, it is the object of the present invention to so develop a spray arm of a coating device in that includes at least one nozzle pipe with nozzle attached thereon that ensures that each of the nozzles, which are connected in series on the nozzle pipe, discharges an equal amount of coating compound per unit of time.

In order to achieve the foregoing objective, the invention includes, in addition to the at least one nozzle pipe, at least one additional delivery pipe.

The essential characteristic feature of the present invention is that at least one other supply pipe is arranged coaxially in the nozzle pipe and that the compound flow to be discharged via the nozzles is separated in that one part of the nozzle flow is introduced via the inner delivery pipe into the nozzle pipe, while another part of the compound flow is introduced directly via the nozzle pipe.

The introduction of two equal compound flows is preferred if the flow cross-section of the inner delivery pipe, which is arranged coaxially in the outer nozzle pipe, is approximately similar to the cross-section of the annulus resulting from the difference between the internal circumference of the nozzle pipe and the external circumference of the delivery pipe. In such a case, equal amounts of compound flow are preferably introduced into the delivery pipe and into the nozzle pipe.

A precise layout of the respective compound flows, that is to say, compound per unit of time, can be provided by applying the technical doctrine of flow mechanics. Here the object is to achieve a distribution of pressure at the nozzles with the varying compound flows, which is as even as possible.

Of course, one can deviate from this rule if the annulus between the nozzle pipe and the outer circumference of the delivery pipe varies from the clear opening of the delivery pipe itself. In this case, the compound flows can be adjusted accordingly.

In the present invention it is provided that the delivery pipe, which is arranged coaxially in the nozzle pipe, in the vicinity of the closed front of the nozzle pipe, is fitted with an orifice through which the compound flow, which is fed into the delivery pipe, escapes from the delivery pipe into the nozzle pipe in the vicinity of said enclosed front.

As a result, the nozzle pipe is supplied from at least two opposite directions with the compound flow, and accordingly the front nozzles of the nozzle pipe are directly supplied with the compound flow from the feeding point of the nozzle pipe (for example, from the left-hand side), while the nozzles arranged at the end of the nozzle pipe are supplied with the compound flow (for example, from the right-hand side) from the delivery pipe.

Accordingly, this no longer produces a proportional profile of pressure, which drops proportionally from the feeding point of the nozzle pipe towards the rear via the length of the nozzle pipe, but, as a result of dual feeding into the nozzle pipe, said proportional drop in pressure is interrupted and balanced by a counter-drop in pressure.

In a further development of the present invention, it can be provided to arrange, in addition to a delivery pipe which is arranged coaxially in the nozzle pipe fitted with nozzles, two or several parallel-connected delivery pipes can be arranged whose discharge openings always enter into the nozzle pipe.

However, it remains an open question whether, for example, one discharge opening of one of the delivery pipes ends in the vicinity of the enclosed front of the nozzle pipe, while the other discharge opening of the second delivery pipe ends at a distance from said enclosed front (for example, in the center of the nozzle pipe).

Also, if the orifice of the delivery pipe, which discharges the coating compound into the nozzle pipe, preference is given to developing said orifice in the form of an inclined plane. The development of the inclined plane has the advantage that the effective discharge orifice of the delivery pipe thus can be enlarged.

In the following, the invention is explained in greater detail by means of drawings which represent only one embodiment. From the drawings and their description, additional inventive characteristic features and advantages of the invention emerge.

The object of the present invention not only results from the subject-matter of the individual claims, but from the combination of individual claims between one another.

All disclosed data and characteristic features contained in the documentation, including the abstract, in particular with respect to the figures shown in the drawings, are considered essential to the invention to the extent that individually or in combination they are novel in terms of the prior art.

The present invention is directed to a spray arm for a coating device. The spray arm includes at least one nozzle pipe having an open end, a closed end, and at least one nozzle positioned between the open end and the closed end and at least one delivery pipe having a supply end and a delivery end. The delivery end may be positioned adjacent the closed end of the at least one nozzle pipe, the open end of the at least one nozzle pipe may be couplable to a coating material supply, and the supply end of the at least one delivery pipe may be couplable to the coating material supply.

In accordance with another feature of the present invention, the at least one nozzle pipe and the at least one delivery pipe may be coaxially arranged.

In accordance with another feature of the present invention, the at least one delivery pipe may be coaxially disposed within the at least one nozzle pipe.

In accordance with still another feature of the present invention, the at least one delivery pipe may be positioned to extend substantially through the at least one nozzle pipe.

In accordance with a further feature of the present invention, the delivery end of the at least one delivery pipe may be angled obliquely with respect to the closed end of the at least one nozzle pipe.

In accordance with a still frier feature of the present invention, the at least one nozzle may include a plurality of nozzles arranged between the open end and the closed end, Further, the plurality of nozzles may be linearly aligned between the open end and the closed end.

In accordance with a still further feature of the present invention, the delivery end of the at least one delivery pipe may be composed of an opening facing at least a portion of one of the plurality of nozzles.

In accordance with still another feature of the present invention, the at least one nozzle and the at least one delivery pipe may be heatable.

In accordance with another feature of the present invention, the device may include a heating pipe that surrounds an outside of the at least one nozzle pipe.

In accordance with still another feature of the present invention, the delivery end of the at least one delivery pipe may lave a cross-sectional area that is substantially equal to a cross-sectional area of an annulus formed between the at least one delivery pipe and the at least one nozzle pipe.

In accordance with yet another feature of the present invention, the at least one delivery pipe and the at least one nozzle pipe may be adapted to be supplied with the coating material at a substantially same location.

In accordance with a further feature of the present invention, the spray arm may be utilized in combination with a coating material supply.

The present invention is also directed to a method of supplying a coating material to a spray arm that includes at least one nozzle pipe having an open end, a closed end, and at least one nozzle between the open end and the closed end and at least one delivery pipe having a supply end and a delivery end, such that the delivery end is positioned adjacent the closed end of the at least one nozzle pipe, the open end of the at least one nozzle pipe is coupled to a coating material supply and the supply end of the at least one delivery pipe is coupled to the coating material supply. The method may include supplying coating material to the at least one nozzle in a first direction substantially along a longitudinal axis of the at least one nozzle pipe and supplying coating material to the at least one nozzle in a second direction, the second direction being substantially opposite the first direction.

In accordance with another feature of the present invention, the supplying of the coating material in the second direction may include directing the coating material through the at least one delivery pipe in substantially the first direction and deviating the directed coating material into the second direction at the closed end of the at least one nozzle pipe.

In accordance with still another feature of the present invention, the method may include forming the delivery end of the at least one delivery pipe with a cross-sectional area substantially equal to a cross-sectional area of an annulus formed between the at least one delivery pipe and the at least one nozzle pipe.

In accordance with yet another feature of the present invention, the method may include arranging the at least one delivery pipe within the at least one nozzle pipe so that a flow volume of the coating material through the at least one delivery pipe is substantially equal to a flow volume of the coating material outside of the at least one delivery pipe.

DETAILED DESCRIPTION OF THE INVENTION

Figures 1, 2, 3:
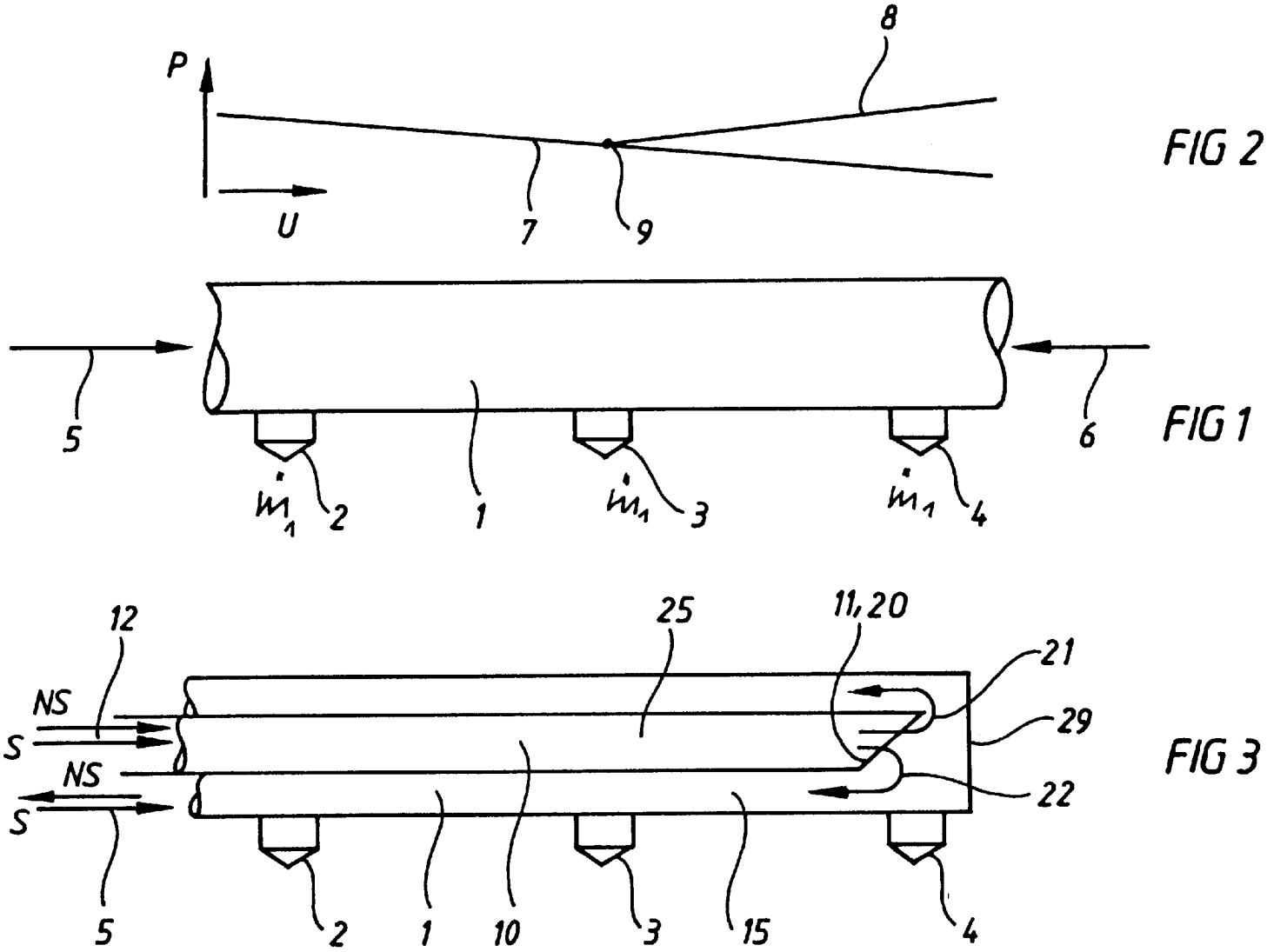
FIG. 1: Shows a schematic view of an embodiment of the invention in the form of a first design.
FIG. 2: Shows the march of pressure over the configuration according to FIG. 1.
FIG. 3: Shows a second design of inventive embodiment.

FIG. 1 shows in a schematic view that the nozzle pipe 1 is fitted with a series of nozzles 2, 3, 4, while an even compound flow m1 per unit of time is to be discharged through each nozzle.

According to the invention, this is achieved in that a compound flow is fed both in the direction of the arrow 5 (for example, from the left end of the nozzle pipe) into the nozzle pipe and an approximately similar amount of compound flow is fed from the right-hand side into the nozzle pipe (in the direction of arrow 6).

In the prior art, for example, the front of the nozzle pipe 1 was enclosed at direction of arrow 6, while, according to FIG. 2, a proportionate drop in pressure in accordance with curve 7 resulted over the entire length of the nozzle pipe 1.

If the right-hand front of the nozzle pipe 1 is opened according to FIG. 1 and a compound flow is additionally fed in the direction of the arrow 6, this will result in the wider curve 8, i.e., the two curves 7, 8 intersect at the point of intersection 9, thus resulting in an evening out of the pressure at the corresponding nozzles 2, 3, 4.

FIG. 3 shows a preferred embodiment of FIG. 1, how, in terms of design, the compound flow can be fed into the nozzle pipe 1 both in the direction of the arrow 5 and in the direction of the arrow 6.

Here in a preferred embodiment it is proposed in that a delivery pipe 10 be inserted coaxially into the nozzle pipe 1 which is enclosed with the front 29, and delivery pipe 10 is provided with an orifice 11 preferably developed in the form of an inclined plane 20.

At the same time, the inner cross-section of the delivery pipe, which is preferably designated as the flow area 25, is approximately the same size as the annulus 15, that is to say, the space between the delivery pipe 10 and the nozzle pipe 1.

If the two cross-sectional planes 15 and 25 are approximately equal, equal amounts of compound flow can be fed in the direction of the arrow 12 into the delivery pipe and in the direction of the arrow 5 into the nozzle pipe.

If, on the other hand, the two spaces 15, 25 differ from each other, the compound flows in the directions of the arrow 5, 12 must be adjusted accordingly.

At the same time, the orifice 11 of the delivery pipe 10 preferably ends at the enclosed front 29 above the last nozzle 4 as closely as possible, in order to preferably supply said nozzle with higher pressure, as is indicated by the curve 8.

The compound flow flowing into the directions of the arrow 21, 22, consequently flow from the rear into the annulus 15, while from the front end the other compound flow, which flows in the direction of the arrow 5, flows in this direction into the nozzle pipe 1.

According to FIG. 2, this evens out the pressure occurring at the nozzles 2, 3, 4, so that said nozzles can discharge an approximately even compound flow per unit of time.

Figures 4, 5, 6:
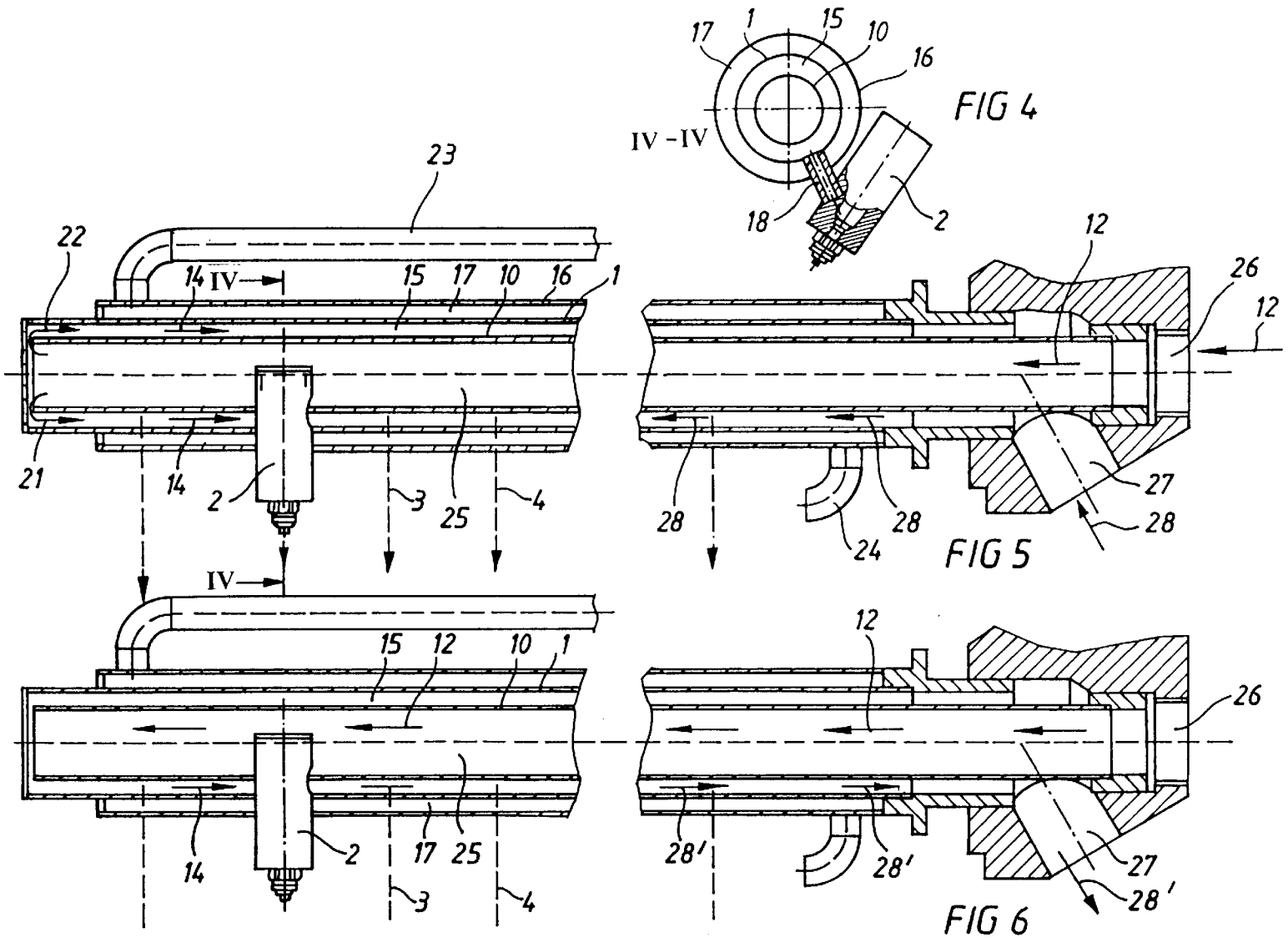
FIG. 4: Shows a cross-section of the configuration according to FIG. 3.
FIG. 5: Shows a lateral of said configuration according to FIG. 3, in the process of spraying.
FIG. 6: Shows the same cross-sectional view as FIG. 5, during a spraying interval.

FIG. 4 shows a cross-section through a configuration in FIG. 3, which shows that the entire configuration (i.e., the nozzle pipe 1) externally also is surrounded by an annulus 17 which is defined by an outside heating pipe 16. Through said heating pipe hot water is withdrawn via the hot water pipe 23, while said hot water is fed via the hot water pipe 24 into the heating jacket.

Also shown as a schematic view is a nozzle 2 which is connected via a junction canal 18 with the annulus 15.

The feeding into the nozzle pipe 1 and delivery pipe 10 is preferably performed from the same side. One possible design is shown in FIG. 5. Both pipes 1, 10 can be loaded from the same pump.

At the inlet 26, the compound flow is fed in the direction of the arrow 12 into the delivery pipe 10, while at the inlet 27, the compound flow is fed into the nozzle pipe 1 in the direction of the arrow 28.

It is clear that the two compound flows (direction of the arrow 28, 14) meet approximately in the center of the nozzle pipe 1.

During the spray interval, the compound flow is reversed, in order to circulate the coating compound in the entire spray arm (FIG. 6).

Here it is provided that at the inlet 26, the coating compound is fed, as before, in the direction of the arrow 12, but that via the inlet 27, while the compound flow escapes in the direction of the arrow 28', in order to achieve a complete circulation.

This prevents the coating compound from being deposited randomly, without the formation of a fatty emulsion when processing chocolate, which might produce lumps and clogging. Everywhere there are round, continuous flow cross-sections, which are not interrupted by major edges, so that such an undesired separation of a fatty, high-viscosity coating compound is avoided.

The above described spray arm is suitable not only for discharging high viscosity, but also low-viscosity liquids in keeping with the flow characteristics of pure water.

In the present description, only three nozzles are shown schematically which are provided with even coating compound. In reality up to 50 nozzles may be distributed over a length of a nozzle pipe which, for example, may have a length of 3 meters. overall, this produces an even distribution of pressure at the nozzles.

What is claimed is:

1. A spray arm for a coating device comprising:

at least one nozzle pipe having an open end, a closed end, and at least one nozzle positioned between the open end and the closed end;

at least one delivery pipe having a supply end and a delivery end, the delivery end being positioned adjacent the closed end of the at least one nozzle pipe;

the open end of the at least one nozzle pipe being couplable to a coating material supply; and the supply end of the at least one delivery pipe being couplable to the coating material supply; and the delivery end of the at least one delivery pipe being angled obliquely with respect to the closed end of the at least one nozzle pipe.

2. The spray arm according to claim 1, the at least one nozzle pipe and the at least one delivery pipe being coaxially arranged.

3. The spray arm according to claim 1, the at least one delivery pipe being coaxially disposed within the at least one nozzle pipe.

4. The spray arm according to claim 1, the at least one delivery pipe positioned to extend substantially through the at least one nozzle pipe.

5. The spray arm according to claim 1, the at least one nozzle comprising a plurality of nozzles arranged between the open end and the closed end.

6. The spray arm according to claim 5, the plurality of nozzles being linearly aligned between the open end and the closed end.

7. The spray arm according to claim 1, the at least one nozzle comprising a plurality of nozzles; and the delivery end of the at least one delivery pipe being composed of an opening facing at least a portion of one of the plurality of nozzles.

8. The spray arm according to claim 1, the at least one nozzle and the at least one delivery pipe being adapted to be heated.

9. The spray arm according to claim 1, further comprising a heating pipe positioned to surround an outside of the at least one nozzle pipe.

10. The spray arm according to claim 1, the at least one delivery pipe and the at least one nozzle pipe adapted to be supplied with the coating material at a substantially same location.

11. The spray arm according to claim 1 in combination with a coating material supply.

12. A spray arm for a coating device comprising:

at least one nozzle pipe having an open end, a closed end, and at least one nozzle positioned between the open end and the closed end;

at least one delivery pipe having a supply end and a delivery end, the delivery end being positioned adjacent the closed end of the at least one nozzle pipe;

the open end of the at least one nozzle pipe being couplable to a coating material supply; and the supply end of the at least one delivery pipe being couplable to the coating material supply; and the delivery end of the at least one delivery pipe having a cross-sectional area that is substantially equal to a cross-sectional area of an annulus formed between the at least one delivery pipe and the at least one nozzle pipe.

13. A method of supplying a coating material to a spray arm that includes at least one nozzle pipe having an open end, a closed end, and at least one nozzle between the open end and the closed end and at least one delivery pipe having a supply end and a delivery end, such that the delivery end is positioned adjacent the closed end of the at least one nozzle pipe, the open end of the at least one nozzle pipe is coupled to a coating material supply and the supply end of the at least one delivery pipe is coupled to the coating material supply, the method comprising:

supplying coating material to the at least one nozzle in a first direction substantially along a longitudinal axis of the at least one nozzle pipe;

supplying coating material to the at least one nozzle in a second direction, the second direction being substantially opposite the first direction; and forming the delivery end of the at least one delivery pipe with a cross-sectional area substantially equal to a cross-sectional area of an annulus formed between the at least one delivery pipe and the at least one nozzle pipe.

14. The method according to claim 13, the supplying of the coating material in the second direction comprising:

directing the coating material through the at least one delivery pipe in substantially the first direction; and deviating the directed coating material into the second direction at the closed end of the at least one nozzle pipe.

15. A method of supplying a coating material to a spray arm that includes at least one nozzle pipe having an open end, a closed end, and at least one nozzle between the open end and the closed end and at least one delivery pipe having a supply end and a delivery end, such that the delivery end is positioned adjacent the closed end of the at least one nozzle pipe, the open end of the at least one nozzle pipe is coupled to a coating material supply and the supply end of the at least one delivery pipe is coupled to the coating material supply, the method comprising:

supplying coating material to the at least one nozzle in a first direction substantially along a longitudinal axis of the at least one nozzle pipe;

supplying coating material to the at least one nozzle in a second direction, the second direction being substantially opposite the first direction; and arranging the at least one delivery pipe within the at least one nozzle pipe so that a flow volume of the coating material through the at least one delivery pipe is substantially equal to a flow volume of the coating material outside of the at least one delivery pipe.

16. A spray arm for a coating device comprising:

at least one nozzle pipe having an open end, a closed end, and at least one nozzle positioned between the open end and the closed end;

at least one delivery pipe having a supply end and a delivery end, the delivery end being positioned adjacent the closed end of the at least one nozzle pipe;

the open end of the at least one nozzle pipe being couplable to a coating material supply; and the supply end of the at least one delivery pipe being couplable to the coating material supply;

the at least one nozzle and the at least one delivery pipe adapted to be heated; and a heating pipe that surrounds an outside of the at least one nozzle pipe.

* * * * *